US007740530B2

(12) United States Patent
Astourian

(10) Patent No.: US 7,740,530 B2
(45) Date of Patent: Jun. 22, 2010

(54) AIR HANDLING SYSTEM

(75) Inventor: Vahe Michael Astourian, Lee's Summit, MO (US)

(73) Assignee: Ruskin Company, Kansas City, MO (US)

( * ) Notice: Subject to any disclaimer, the term of this patent is extended or adjusted under 35 U.S.C. 154(b) by 1014 days.

(21) Appl. No.: 11/382,749

(22) Filed: May 11, 2006

(65) Prior Publication Data

US 2007/0264922 A1 Nov. 15, 2007

(51) Int. Cl.
*F24F 13/08* (2006.01)
*F24F 7/04* (2006.01)
*B01D 39/08* (2006.01)

(52) U.S. Cl. ..... 454/277; 454/254; 454/276; 219/201; 55/525; 55/DIG. 37

(58) Field of Classification Search ..... 454/254, 454/275, 276, 277; 219/201; 55/525, DIG. 37
See application file for complete search history.

(56) References Cited

U.S. PATENT DOCUMENTS 1,548,839 A * 8/1925 Henshall ..... 55/440
3,279,883 A * 10/1966 Thompson et al. ..... 422/4
3,435,671 A * 4/1969 Hildt ..... 73/147
4,697,462 A * 10/1987 Daube et al. ..... 73/863.21
4,814,081 A * 3/1989 Malinowski ..... 210/489
5,074,117 A 12/1991 Kane et al.
5,099,879 A * 3/1992 Baird ..... 137/561 A
5,191,767 A 3/1993 Kane et al.
5,791,984 A 8/1998 Kane
6,589,111 B1 * 7/2003 Giroux ..... 454/254

FOREIGN PATENT DOCUMENTS

JP 61211648 A * 9/1986
JP 61211649 A * 9/1986
JP 61211652 A * 9/1986
JP 62266344 A * 11/1987

* cited by examiner

*Primary Examiner*—Steven B McAllister
*Assistant Examiner*—Patrick F. O'Reilly, III
(74) *Attorney, Agent, or Firm*—Husch Blackwell Sanders LLP

(57) ABSTRACT

An air handling system with an air intake device is provided. The air intake device includes first and second air/water separators having a baffle device positioned between the two separators to redirect the air flow from the first separator so that it is flowing generally longitudinally of the air intake device flow passage. A heater is provided to heat flowing air and snow for collection on a second separator having a foraminous device for subsequent collection and drainage from the air intake device.

10 Claims, 4 Drawing Sheets

AIR HANDLING SYSTEM

BACKGROUND OF THE INVENTION

Air handling systems for the intake and distribution of air within a building are well known. They generally comprise an air intake device positioned at the intake end of a ductwork system, and some form of air pump, for example, a fan, that will induce air flow into the inlet and through the ductwork system to points of distribution within a building. The moving air may be processed by heating devices, cooling devices, dehumidifying devices and/or humidifying devices, as is desired. The air is then discharged through one or more discharges at desired locations within the building.

Outside air is normally drawn into the building. The air is brought through an intake device which, is designed to reduce the amount of liquid water, e.g., rain, that might try to enter the inlet of the intake device. Typically, this is done through the use of upwardly and inwardly inclined louvers. The incoming air impinges on the louvers and entrained liquid water will impinge on the louvers and be collected in a collection pan for subsequent discharge through one or more drains. The air speed across the louvers is such as to assist in the impingement of the water on the louvers and its subsequent collection and draining. If the air flow is too fast, the liquid water may be carried past the louvers and into the remainder of the air handling system. This can present several problems, including damage to moisture sensitive materials and equipment, and provide an environment for microbial growth within the air handling system.

The construction and operation of such systems are well known and generally effective. However, frozen water in the form of snow or sleet and in particular snow may, because of its properties, bypass collection at the louvers and enter the air handling system, thaw, and create problems similar to the intake of liquid water. Various attempts have been made to solve this problem. For example, U.S. Pat. No. 5,791,984 discloses an air handling system with snow removal capabilities. It utilizes a mesh pad interposed in the flow path immediately downstream of the louvers. Snow will impinge on the mesh pad which is heated by a heater to effect melting of the snow for subsequent collection and drainage from the air intake. However, this device has had its drawbacks. The mesh pad tended to plug up with snow in the upper portion rendering that portion impervious to or restricted flow through thereby elevating the flow rate through the remaining open portion of the flow path, forcing the water thru the pad requiring more energy to move the needed amount of air.

Air inlet sections of air handling systems tend to be short in the direction of flow, on the order of two feet or less, providing limited space for added air handling devices or other modifications. There is thus a need for an improved air intake device of an air handling system that will reduce the amount of frozen water entering the air handling system downstream of the air intake.

SUMMARY OF THE INVENTION

The present invention involves the provision of an air handling system for a building. The air handling system includes an intake device having a housing defining a flow path. A plurality of angled louvers are provided and are positioned adjacent to an inlet opening and divides the open inlet end of the intake device into a plurality of flow paths. The louvers are angled upwardly and inwardly such that incoming air impinges on an air deflecting surface of each louver for collection and drainage. A baffle device is positioned downstream of the louver device and is operable to change the direction of flow of incoming air flowing from the louvers. The baffle device provides a plurality of through flow passages and have a length at least equal to the height of the flow passages. An air heating device is positioned on the downstream side of the baffle device and is operable to heat incoming snow or other frozen precipitation. The heating device has a portion adapted for separating the melted snow from the flowing air.

BRIEF DESCRIPTION OF THE DRAWINGS

Like numbers throughout the various Figures designate like or similar parts and/or structure.

DETAILED DESCRIPTION

Figure 5:
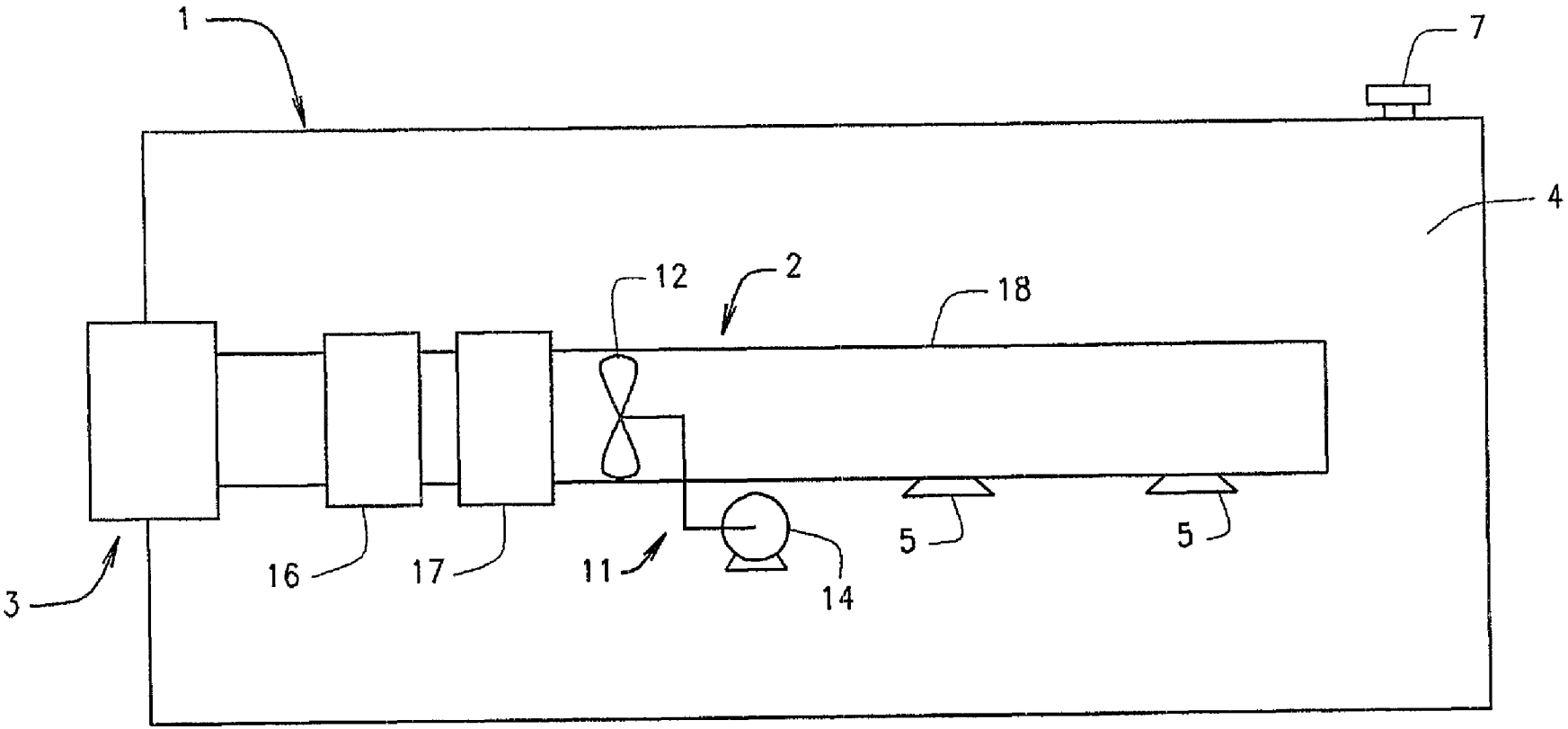
FIG. 5 is a simplified schematic illustration of an air handling system for a building.

In the figures, reference numeral 1 designates an enclosure such as a building (see FIG. 5) which includes an air handling system designated generally 2 for inducing air to flow through an intake device 3 for conditioning and discharge into the interior 4 of the building 1 through discharge outlets 5 at desired locations within the building 1. An exhaust 7 may be provided for exhausting air from the interior 4 back to the exterior of the building 1. The air handling system 2 includes an air pump device designated generally 11 which may include a fan or blower 12 or the like driven by a power drive device such as an electric motor 14. The air handling system 2 may include devices to change the properties of the air. Such devices can include an air conditioner 16 for cooling incoming air and a heater 17 for heating the incoming air. Dehumidification may also be effected, as in the air conditioning unit 16 or in a separate unit as desired. A humidifying unit may also be provided as in the heater 17 as are well known in the art. The air handling system 2 includes a ductwork system designated generally 18 that connects the intake device 3 to the various discharge devices 5. Generally, the cross sectional shape of the ductwork 18 and the intake device 3 are generally rectangular although other shapes such as round may be utilized. The intake device 3 is typically mounted to a vertical wall of the building 1 providing a flow path between the interior and the exterior of the building 1.

Figure 1:
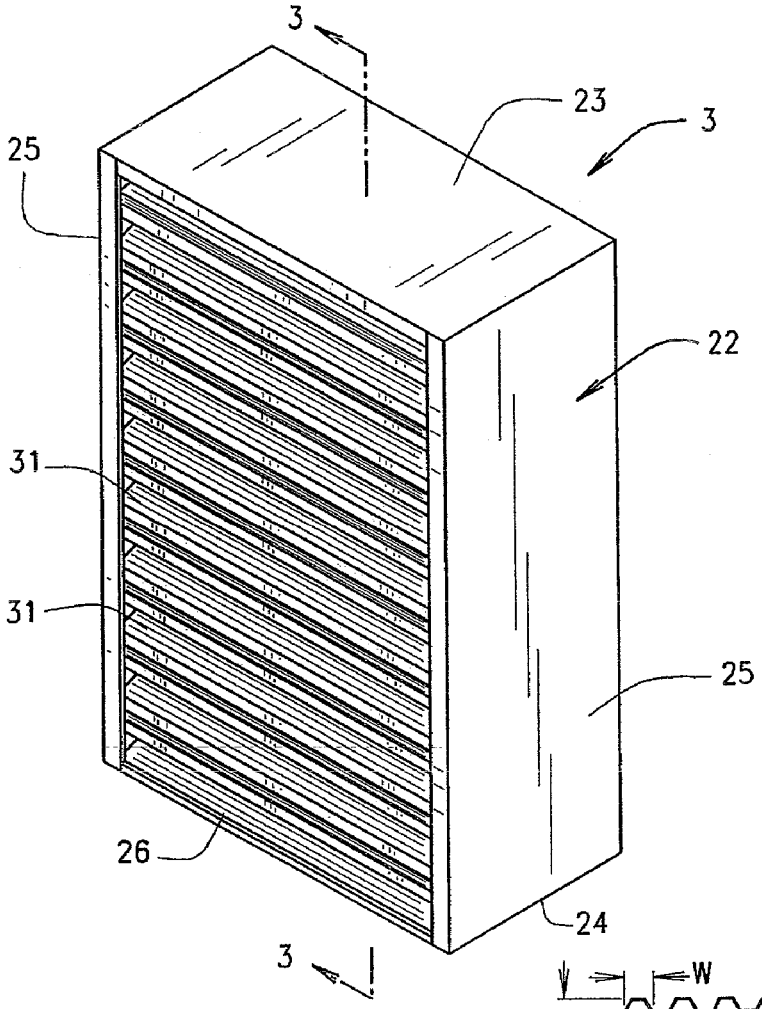
FIG. 1 is a perspective view of an air intake device for use with an air handling system.
Figure 2:
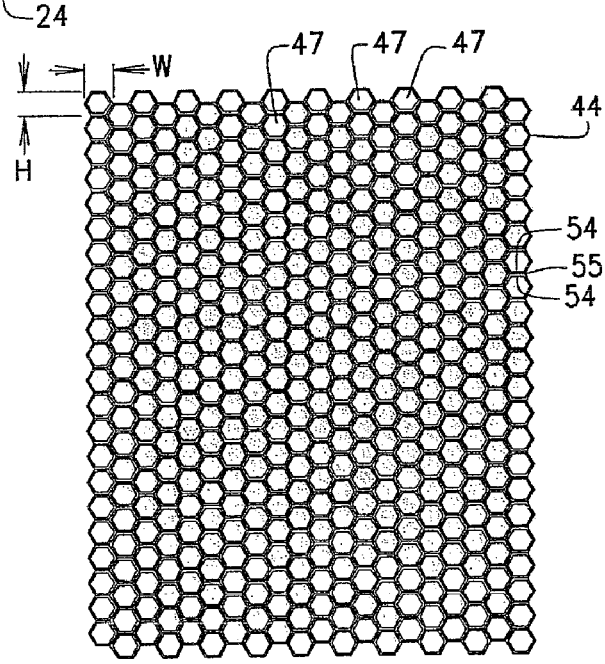
FIG. 2 is a front view of a baffle device used in the air intake device.
Figure 3:
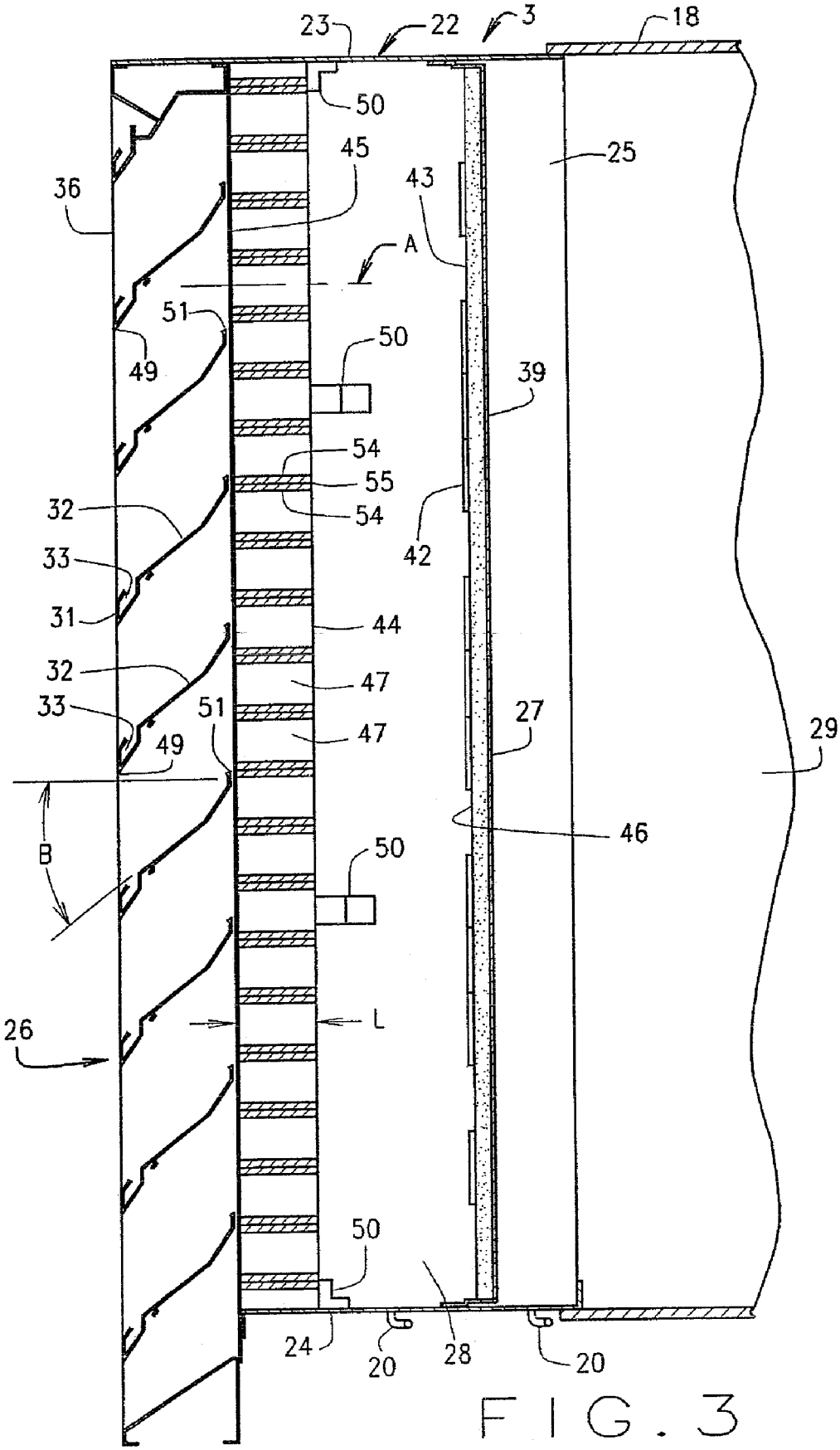
FIG. 3 is a side sectional view of the air intake device portion of an air handling system taken along the line 3-3 of FIG. 1.
Figure 4:
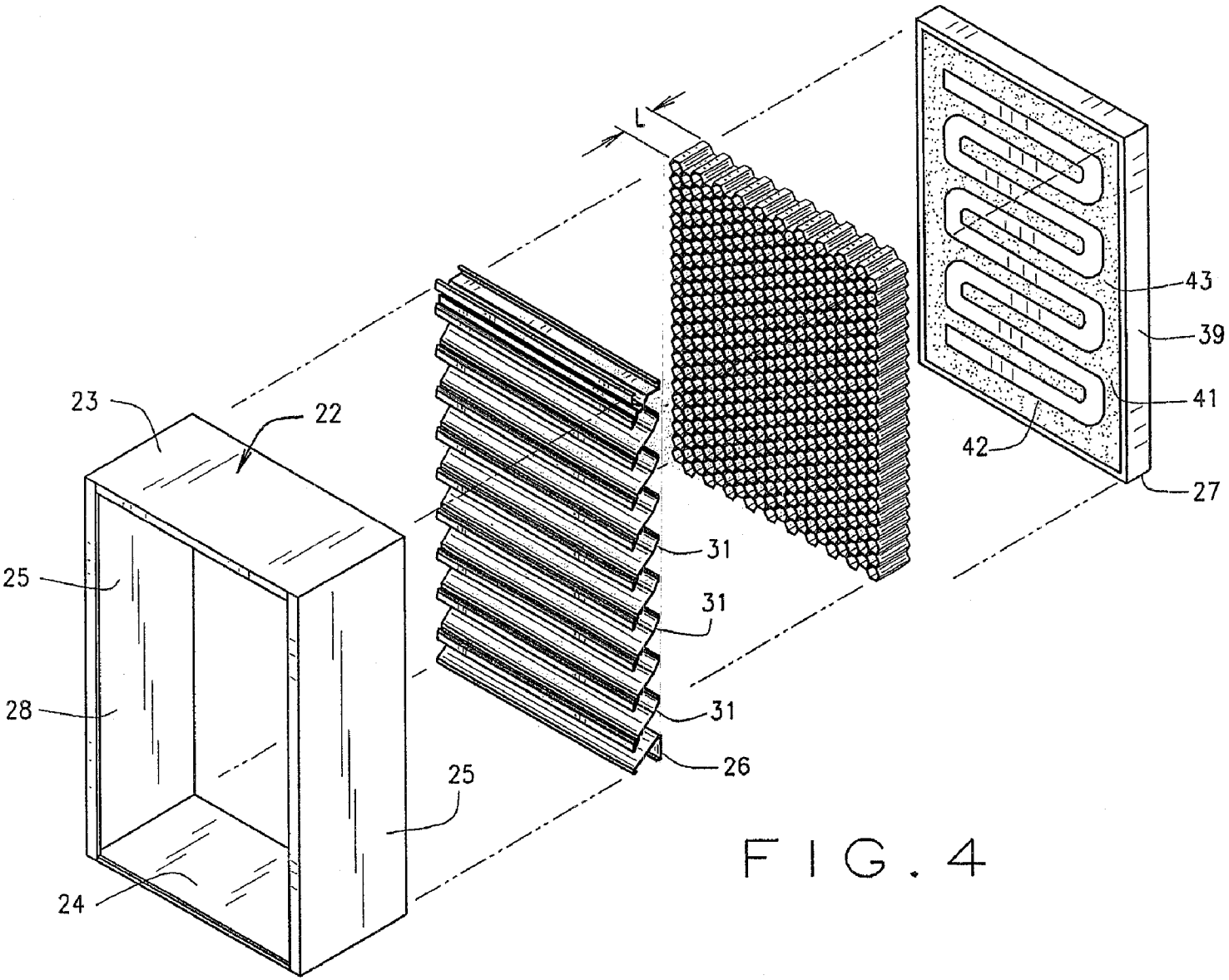
FIG. 4 is an exploded perspective view of the air intake device.

FIG. 3 shows a side sectional view of the intake 3. The terms top and bottom are those portions of the air intake 3 as the air intake would be normally positioned for use with the drains 20 being at the bottom as shown in FIG. 3. All air flow directions are described as if there is no turbulence.

As best seen in FIG. 3, the intake 3 includes an outer housing 22 having at least one sidewall and as shown generally opposed top and bottom walls 23, 24 and generally opposed side walls 25 to provide a rectangular assembly. The bottom wall 24 can be constructed to function as a water collection pan to be drained by drains 20. In a preferred embodiment, the housing 22 has a generally rectangular transverse cross sectional shape as do components of the ductwork 18. The housing 22 is suitably connected to the ductwork 18 to provide a flow path from the exterior of the building to the interior of the building through the ductwork 18. Preferably, the housing 22 is comprised of metallic walls 23-25 that are corrosion resistant, as for example, aluminum or stainless steel. However, other suitable materials can be utilized such as polymeric materials or galvanized steel. The intake 3 includes first and second separating devices 26, 27 that are spaced apart along the longitudinal axis of the housing 22. The separators 26, 27 are operable to separate out water that is entrained in the air entering the housing 22. Preferably, the separation is by mechanical means. The separator 27 is located within the flow path 28 defined by the housing 22. The flow path 28 is co-extensive with a flow path 29 of the ductwork 18.

The separator 26 is preferably in the form of a plurality of generally horizontally extending louvers 31 having a wall portion 32 that is upwardly and inwardly inclined for incoming air to impinge upon. By impinging on the wall 32, liquid water in the air adheres to the walls 32 and flows downwardly to a collection trough 33 for drainage to the bottom of the louver arrangement for discharge therefrom. By using a louver arrangement, a surface area of the inlet end 36 is generally equal to the cross sectional area of the flow path 28. Preferably, the louvers 31 are made of a metallic material such as aluminum or stainless steel that provides the needed strength and corrosion resistance. The louvers 31 prevent or reduce ingress of liquid water into the ductwork 18 and flow path 29. Guards, such as a screens or filters, not shown, may also be provided to prevent the ingress of debris, animals and the like in the event the openings between the louvers 31 are large enough to permit their ingress.

The separator 27 is shown as mounted within the housing 22 and extends substantially across the entirety of the flow path 28 and has its central plane preferably generally normal to the longitudinal axis of the housing 22 and flow path 28. In the illustrated structure, separator 27 includes a support frame 39 suitably secured to the walls 23-25 with the frame 39 providing a through flow path for air to flow therethrough without excessive pressure drop. A foraminous member 41 is carried by the frame 39 and is preferably in the form of a mesh pad with a plurality of through openings and presenting surfaces for contact between the flowing air with entrained liquid water, snow or other forms or frozen water whereby impingement of water in liquid or frozen form on the foraminous member 41 will effect separation of the water from the entraining air and subsequent downward draining to one or both of the drains 20. Preferably, the foraminous member 41 is a metal mesh that transfers heat from a heating device 42 that is positioned in heat transfer relationship to the foraminous member 41. The heater 42 is preferably in direct conductive heat transfer relationship with the foraminous member 41 to transfer heat thereto. Preferably the heater 42 is an electrically resistant heater that will heat air and entrained frozen water when it flows over the heater 42 and contacts surfaces of the member 41. A preferred heater is a metal sheathed cable heat trace. The resistive element is electrically insulated from an exterior metal sheathing with an insulating material like magnesium oxide. The sheathing is preferably a good heat conductive material that is corrosion resistant, for example, Alloy 825 Inconnel. The heat output of the heater device 42 is adequate to melt snow or other entrained frozen water passing into the flow path 28. It has been found that a heater output of approximately 60 watts per square inch of cross sectional dimension of the flow path 28 has been found usable. The foraminous member 41 is preferably a metal multi-layer mesh pad having a density of between about 3 lbs./cubic foot and about 12 lbs./cubic foot of surface area per square inch of the leading face 43 of the foraminous member 41.

The intake device 3 is provided with a baffle device 44 interposed in the flow path 28 between the outlet side 45 of the separator 26 and the inlet side 46 of the separator 27 and preferably extends across substantially or the entirety of the flow path 28. The baffle 44 may be held in place by being sandwiched between the downstream side of the separator 26 and stops 50. The baffle device 44 has a plurality of through flow passages or paths 47 that have a vertical height H and a transverse with W. The through passages 47 have a length L. The size and shape of the passages 47 is such as to change the direction of flow of the air in the space between the louvers 31 from upwardly and inwardly to being generally parallel to the longitudinal axis of the flow path 28 to impinge in a generally normal direction, absent turbulence, on the upstream face 43 of the separator 27. Stated otherwise, the longitudinal axes of the passages 47 are generally normal to the central plane of the separator 27.

The louver walls 32 lie generally in a plane at an acute angle B relative to the longitudinal axis of the flow path 28. Air entering the flow paths between the louvers 31 is then directed generally upwardly and inwardly. This helps effect separation of entrained liquid water from the air as described above. The planes of the walls 32 are also at an acute angle to the longitudinal axes A of the passages 47 since the longitudinal axes of the passages 47 are generally parallel to the longitudinal axis of the flow path 28. The acute angle B is on the order of about 30 to about 60 degrees. Atop end 51 of a wall 32 is at or above the level of the immediately above bottom end 49 to help ensure impingement of entrained water onto the wall 32. The length L of a flow passage 47 is preferably at least equal to the height H of the flow passage, preferably at least about 1.5 times the height H and most preferably at least about two times the height H. In the illustrated structure, the transverse cross sectional shape of the flow passages 47 is generally hexagonal or a portion of a hex at the edges of the baffle 44. This allows for easy manufacture of the baffle 44 by adhering various zones of deformable webs 54 together as at 55 and then expanding the layered composite to form the hexagonal shapes. It is to be understood, that the baffle 44 may be formed from a polymeric material and be molded if desired.

The present invention is better understood by a description of the operation thereof. The intake device 3 is mounted to, for example, a wall of a building 1. It is connected in flow communication with the ductwork 18. The louvers 31 are positioned whereby the walls 32 are upwardly and inwardly inclined. In operation, when snow, sleet or other frozen water is entrained in the incoming air, the heater 42 is activated. Sensors may be provided to automatically activate and deactivate the heater 42. The air pump 11 is activated to draw air from the outside of the building into the intake 3 to pass over the louvers 31 and to impinge on the walls 32 to first separate a substantial portion of any entrained liquid from the flowing air. After passing over the walls 32, the inflowing air then passes through the flow passages 47 and is redirected from upwardly and inwardly to generally longitudinally to then impinge upon the heater 42 and then pass through the foraminous member 41 to melt the snow or the like and collect the melted snow or the like for subsequent draining to the draining pan and then out a drain 20.

Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations, and other uses and applications of the present construction will, however, become apparent to those skilled in the art after considering the specification and the accompanying drawings.

The invention claimed is:

1. A self-contained intake device configured for connection to an air flow system for a building, said intake device including:

a self-contained housing defining a first flow path with a first, open end at an upstream end of the first flow path and a second end at a downstream end of the first flow path configured to be coupled to a duct, the housing further including a plurality of walls extending in the direction of the first flow path;

a louver device having a plurality of inclined louvers positioned adjacent the open end dividing the open end into a plurality of second flow paths and operable to redirect flow of air to flow upwardly and inwardly to separate water from air;

a baffle device positioned in the first flow path contiguous to a downstream face of the louver device, said baffle device having a plurality of adjacent third flow paths having a third flow path length at least about one times the major cross sectional height dimension of the third flow path and operable to change flow direction of air flowing between the louvers to generally parallel to the extending direction of the plurality of walls of the first flow path;

an air heater extending across at least a portion of the first flow path downstream of the baffle device and operable for melting snow conveyed into the first flow path and separating it from the flowing air; and a foraminous device associated with the heater and operable to separate the melted snow from the air flowing through a foraminous portion thereof, the foraminous device extending substantially across the first flow path.

2. The self-contained intake device as set forth in claim 1 wherein the louvers being upwardly inclined from an upstream face of the louvers and operable to separate liquid water from air flowing into the second flow paths.

3. The self-contained intake device as set forth in claim 2 wherein the baffle device including a member positioned transversely across the first flow path and forming a plurality of said third flow paths having a respective longitudinal axis generally parallel to a longitudinal axis of the first flow path.

4. The self-contained intake device as set forth in claim 3 wherein the foraminous device includes a mesh pad extending generally transversely across the first flow path and said heater is in heat transfer relationship to the mesh pad.

5. The self-contained intake device as set forth in claim 4 wherein the heater including an electrical resistance heater in conductive heat transfer relationship with the mesh pad.

6. The self-contained intake device as set forth in claim 5 wherein the heater being mounted on an upstream side of the mesh pad.

7. The self-contained intake device as set forth in claim 5 including at least one drain communicating with the first flow path and operable to drain liquid water collected in the housing.

8. The self-contained intake device as set forth in claim 7 wherein the baffle device member having a generally rectangular transverse cross sectional shape.

9. The self-contained intake device as set forth in claim 3 wherein the baffle device member including a plurality of generally hexagonally shaped third flow paths having a length at least 1.5 times the height.

10. A self-contained intake device configured for connection to an air flow system for a building, said intake device including:

a self-contained housing defining a first flow path with a longitudinal axis and a first, open end at an upstream end of the first flow path and a second end at a downstream end of the first flow path configured to be coupled to a duct, the housing further including a plurality of walls extending in the direction of the first flow path;

a first air/water separator positioned adjacent the open end dividing the open end into a plurality of second flow paths and operable to direct flow of air at an upward angle relative to the longitudinal axis and separate liquid water from air;

a baffle device positioned in the first flow path contiguos to a downstream face of the first air/water separator, said baffle device having a plurality of adjacent third flow paths having a flow path length of at least about 1.5 times a major cross sectional dimension of the third flow path height and having a second longitudinal axis generally parallel to the first longitudinal axis and generally parallel to the extending direction of the plurality of walls; and a heater device including a heater and a second air/water separator extending substantially across the first flow path downstream of the baffle device and operable for melting snow conveyed into the first flow path and separating it from the flowing air.

* * * * *